US007518622B2

(12) United States Patent
Ochi

(10) Patent No.: US 7,518,622 B2
(45) Date of Patent: Apr. 14, 2009

(54) IMAGE DISPLAY APPARATUS

(75) Inventor: Yutaka Ochi, Yokohama (JP)

(73) Assignee: Victor Company of Japan, Ltd., Kanagawa-Ken (JP)

( * ) Notice: Subject to any disclaimer, the term of this patent is extended or adjusted under 35 U.S.C. 154(b) by 608 days.

(21) Appl. No.: 11/320,091

(22) Filed: Dec. 28, 2005

(65) Prior Publication Data

US 2008/0018559 A1 Jan. 24, 2008

(30) Foreign Application Priority Data

Jan. 6, 2005 (JP) ..... 2005-001797
Dec. 21, 2005 (JP) ..... 2005-367332

(51) Int. Cl.
*G09G 5/10* (2006.01)

(52) U.S. Cl. ..... 345/690; 345/100

(58) Field of Classification Search ..... 345/690, 345/100, 60, 87, 605, 10, 76, 75.2, 204, 596, 345/89, 98, 59; 315/169.2; 358/3.13
See application file for complete search history.

(56) References Cited

U.S. PATENT DOCUMENTS 7,057,597 B2 * 6/2006 Ikeda ..... 345/95
7,256,794 B2 * 8/2007 Myoung et al. ..... 345/596

FOREIGN PATENT DOCUMENTS

| | | |
|---|---|---|
| JP | 09-171368 | 6/1997 |
| JP | 10-149132 | 6/1998 |
| JP | 2000-231359 | 8/2000 |

* cited by examiner

*Primary Examiner*—Abbas I Abdulselam
(74) *Attorney, Agent, or Firm*—Renner, Kenner, Greive, Bobak, Taylor & Weber

(57) ABSTRACT

An image display apparatus that has a display section provided with a first plurality of pixels arranged in a matrix. Sequentially generated are dither signals each formed in a matrix of P rows×Q columns (P and Q being both positive integers and at least either one being 2 or more) corresponding to a second plurality of pixels that are a part of the first plurality of pixels in the display section, in order to enhance the gradation levels of a first image signal. The dither signals are sequentially added to the pixel data of the first image signal, thus a second image signal being output with enhanced gradation levels. One frame of the second image signal is divided into a plurality of subframes, thus a subframe signal being generated. Data per line carried by the subframe signal is sequentially supplied to column-signal electrodes connected to the pixels of the display section. Data per line carried by the subframe signal is sequentially supplied to pixels of rows corresponding to respective lines. The first plurality of pixels of the display section are grouped in the same unit of group as the second plurality of pixels. The display section is driven to display pixel data of each of the second plurality of pixels in each group for each of display periods provided in the same number as the second plurality.

3 Claims, 14 Drawing Sheets

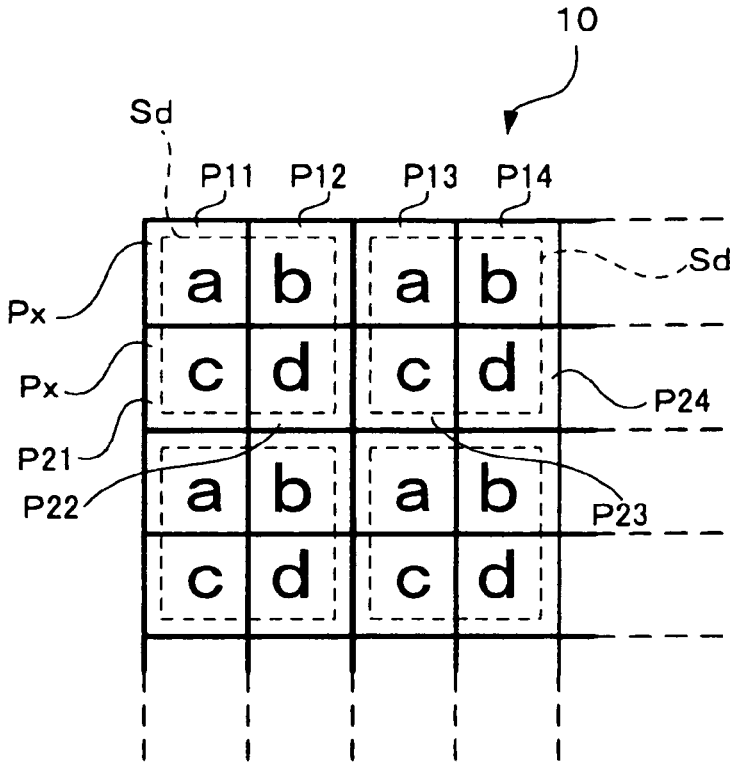
FIG. 1
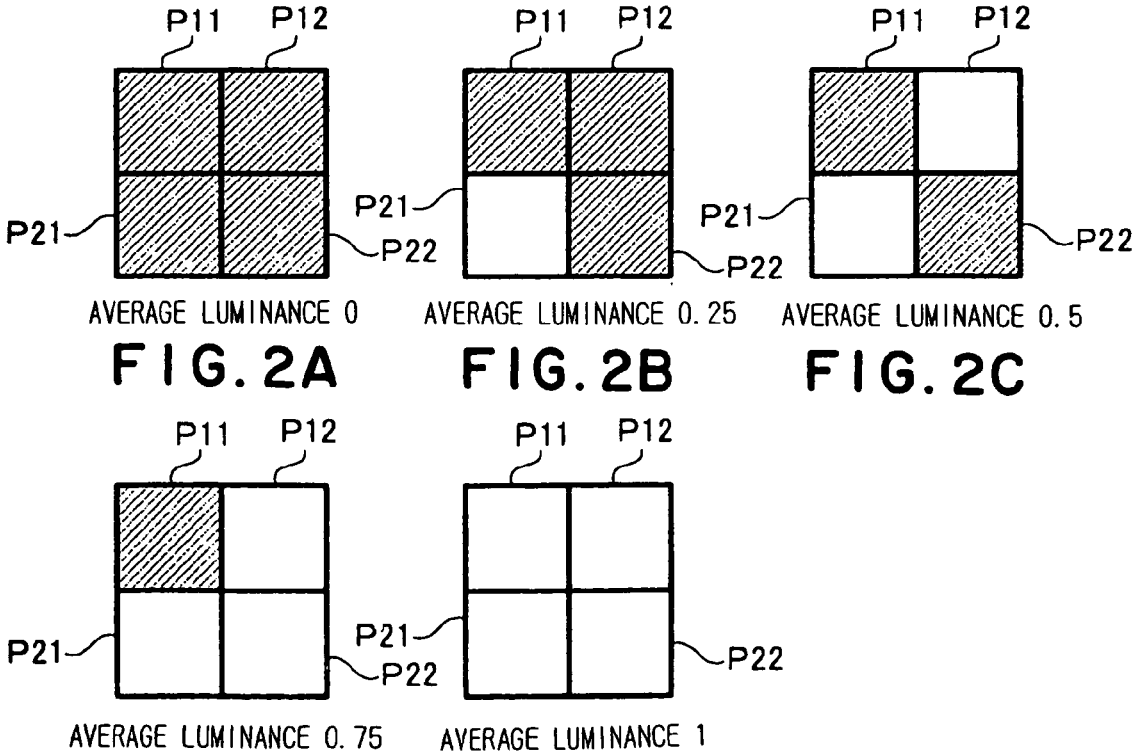
FIG. 2A FIG. 2B FIG. 2C
FIG. 2D FIG. 2E

AVERAGE LUMINANCE 0

AVERAGE LUMINANCE 0.1

AVERAGE LUMINANCE 0.2

AVERAGE LUMINANCE 0.3

AVERAGE LUMINANCE 0.4

AVERAGE LUMINANCE 0.5

AVERAGE LUMINANCE 0.6

AVERAGE LUMINANCE 0.7

AVERAGE LUMINANCE 0.8

AVERAGE LUMINANCE 0.9

AVERAGE LUMINANCE 1.0

AVERAGE LUMINANCE 0

AVERAGE LUMINANCE 0.3

AVERAGE LUMINANCE 0.7

AVERAGE LUMINANCE 1.0

IMAGE DISPLAY APPARATUS

CROSS-REFERENCE TO RELATED APPLICATIONS

This application is based on and claims the benefit of priority from the prior Japanese Patent Application No. 2005-001797 filed on Jan. 6, 2005 and No. 2005-367332 filed on Dec. 21, 2005, the entire contents of which are incorporated herein by reference.

BACKGROUND OF THE INVENTION

The present invention relates to an image display apparatus, such as, liquid crystal display apparatuses (LCDs), plasma display panel apparatuses (PDPs), digital light processing display apparatuses (DLPs), field emission display apparatuses (FEDs), and electroluminescent display apparatuses (ELs), particularly, to an image display apparatus for displaying images of digital input image signals through division of one frame to a plurality of subframes.

A recent panel-type image display apparatus, such as, LCD, PDP, DLP, FED, and EL employs a drive system for digital input image signals, which is quite different from known image display apparatuses with a cathode-ray tube (CRT). The panel-type image display apparatus displays images through division of one frame of an image signal into a plurality of subframes for representing a plurality of gradation levels (refer to Japanese Patent No. 349864, for example). Moreover, the panel-type image display apparatus requires reverse-gamma correction of an input image signal which has already been applied reverse-gamma characteristics, through a built-in reverse-gamma correction circuit, for an output signal (luminescence intensity) the characteristics of which linearly varies against the input signal.

The panel-type image display apparatus provides step-by-step gradation representation due to image display through digital driving, with application of reverse-gamma characteristics to an input image signal, resulting in difficulty in gaining correct gradation characteristics, particularly, for the image signal at lower gradation levels. It is thus customary to install a quasi-intermediate gradation signal generating circuit using dither or error diffusion to achieve quasi-intermediate gradation representation between adjacent gradation levels, as disclosed in the Japanese Patent.

Such known quasi-intermediate gradation through a quasi-intermediate gradation signal generating circuit has, however, difficulty in achieving further multi-gradation and hence cannot meet increased demand of multi-gradation in image display apparatuses. Enhancement of representable gradation levels could be achieved by increasing the number of subframes within one frame, which inevitably requires a higher operating frequency for an image display apparatus. A higher operating frequency necessitates modification to basic design of an image display apparatus. It is however unacceptable to raise an operating frequency due to the fact that there is limitation on increase in operating frequency for the integrated circuitry to drive an image display apparatus, and a higher operating frequency causes excess heat. Especially, PDPs suffer a lowered intensity when the number of subframes is increased, thus multi-gradation through increase in subframe numbers is not a feasible way.

SUMMARY OF THE INVENTION

In views of the problems discussed above, a purpose of the present invention is to provide an image display apparatus with enhanced representable gradation levels without increasing the number of subframes within one frame.

The present invention provides an image display apparatus having a display section provided with a first plurality of pixels arranged in a matrix, comprising: a dither signal generating circuit to sequentially generate and output dither signals each formed in a matrix of P rows×Q columns (P and Q being both positive integers and at least either one being 2 or more) corresponding to a second plurality of pixels that are a part of the first plurality of pixels in the display section, in order to enhance gradation levels of a first image signal; an adder to sequentially add the dither signals to pixel data of the first image signal, thus outputting a second image signal with enhanced gradation levels; a subframe generating circuit to divide one frame of the second image signal into a plurality of subframes, thus generating and outputting a subframe signal; a column-signal electrode drive circuit, having a shift register for use in horizontal transfer, to sequentially supply data per line carried by the subframe signal to column-signal electrodes connected to the pixels of the display section; and a row-scanning-signal electrode drive circuit, having a shift register for use in vertical transfer, to sequentially supply data per line carried by the subframe signal to pixels of rows corresponding to respective lines, wherein at least either one of the column-signal electrode drive circuit and the row-scanning-signal electrode drive circuit has a plurality of shift registers, the first plurality of pixels of the display section are grouped in the same unit of group as the second plurality of pixels through one or more of the shift registers of the column-signal electrode drive circuit and one or more of the shift registers of the row-scanning-signal electrode drive circuit, and the column-signal electrode drive circuit and the row-scanning-signal electrode drive circuit drive the display section to display pixel data of each of the second plurality of pixels in each group for each of display periods provided in the same number as the second plurality.

BRIEF DESCRIPTION OF DRAWINGS

FIG. 1 is a view illustrating a relation between pixel arrangements on a display panel and addition of dither signals to pixel data;

FIGS. 2A to 2E are views illustrating quasi-intermediate gradation display by means of a dither signal;

DETAILED DESCRIPTION OF PREFERRED EMBODIMENTS

Figure 3:
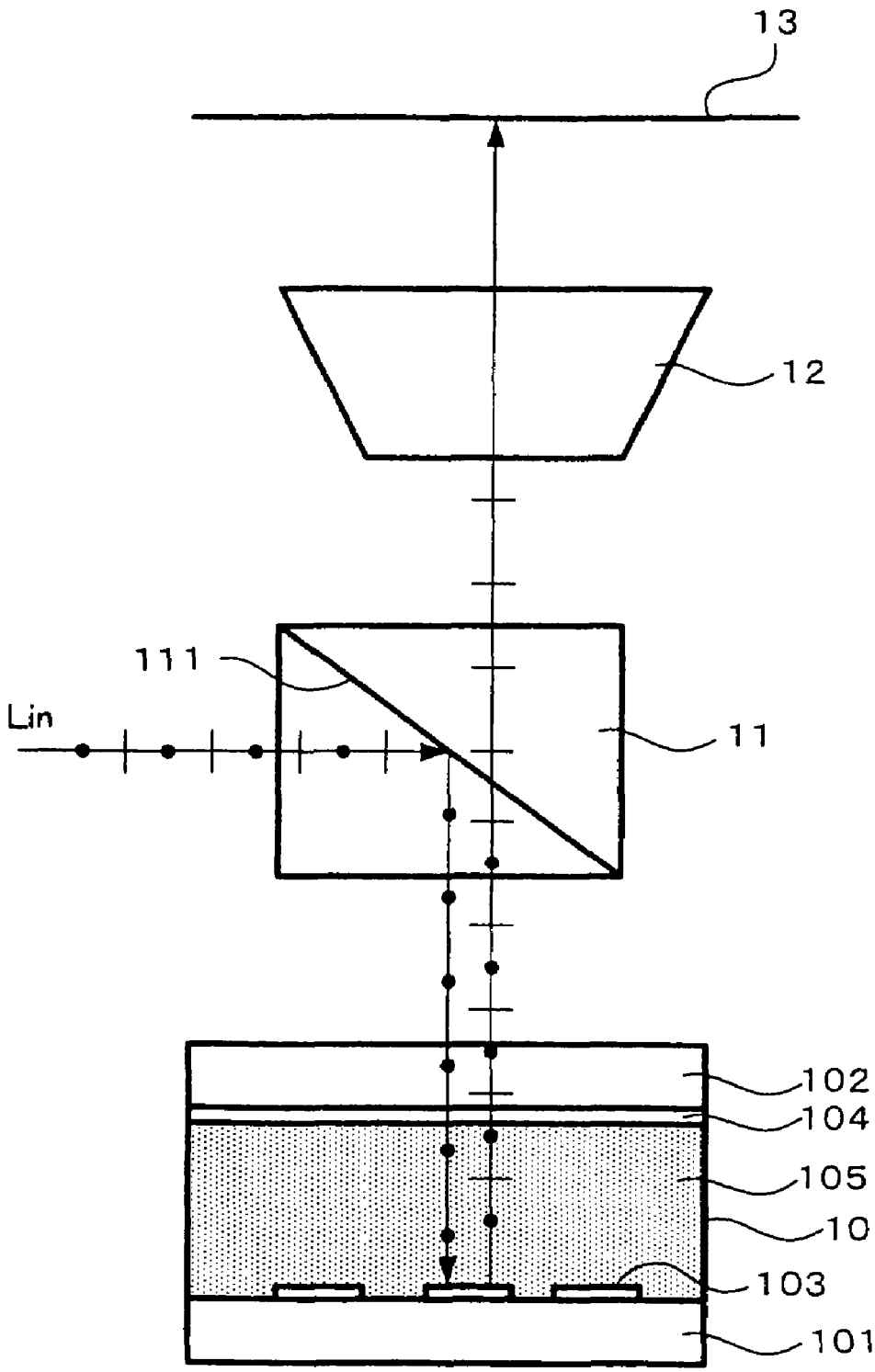
FIG. 3 is a view showing an outline structure of a projection display apparatus as an example of an image display apparatus.

Before description of each embodiment, described first is quasi-intermediate gradation representation by means of dither used in each embodiment of the present invention. As shown in FIG. 1, a display panel 10, in a panel-type image display apparatus, has a plurality of pixels Px arranged in a matrix of rows and columns. Although, technically, each pixel Px consists of dots in primary colors of R, G and B, it is just referred to as a pixel Px in a simplified manner with no consideration of colors. Arranged in the uppermost row in FIG. 1 are pixels P11, P12, P13, P14, . . . , followed by pixels P21, P22, P23, P24, . . . , in the second row, as pixels Px.

An exemplary technique, in quasi-multi-gradation by means of dither in the display panel 10 with such arrangements, is to add a dither signal Sd of 2 rows×2 columns consisting of "a", "b", "c" and "d" to pixel data (dot data) to be applied to pixels Px of 2 rows×2 columns. The dither signal Sd is formed in a matrix consisting of P rows×Q columns (P and Q being both positive integers and at least either one being 2 or more), P and Q being set according to need, as discussed in each embodiment which will be disclosed later. The number of bits of the values "a", "b", "c" and "d" in the dither signal Sd are set at, for example 2 bits, according to need. As shown in FIG. 1, pixels Px of 2 rows×2 columns are put together in one group in the display panel 10, pixel data of each group being added by the dither signal Sd. Although the dither signal Sd is always referred to as having "a", "b", "c" and "d" for convenience, they may not always the same values, i.e., the values of "a", "b", "c" and "d" are changed according to the gradation levels of pixel data, changed per frame, etc.

When focusing on the group of the pixels P11, P12, P21 and P22, the average luminance is 0 for the four pixels in this group when all of the pixels P11, P12, P21 and P22 are off (not displayed) as shown in FIG. 2A. The average luminance is 1 for the four pixels in this group when all of the pixels P11, P12, P21 and P22 are on (displayed) as shown in FIG. 2E. The average luminance turns into 0.25 when the pixels P11, P12 and P22 are off while the pixel P21 is on, as shown in FIG. 2B, by adding the dither signal Sd to pixel data of this group. The average luminance turns into 0.5 when the pixels P11 and P22 are off while the pixels P12 and P21 are on, as shown in FIG. 2C, by adding the dither signal Sd to pixel data of this group, likewise, 0.75 when the pixel P11 is off while the pixels P12, P21 and P22 are on, as shown in FIG. 2D.

As described above, in dither to add the dither signal Sd to pixel data of each group, combination of on and off for pixels in a group provides intermediate luminance (intermediate gradation) representation between the average luminance 0 and 1 through area gradation representation. For example, in FIG. 2B, the average luminance of 0.25 is also achieved by turning on one of the pixels P11, P12 and P22, instead of the pixel P21, likewise, the average luminance in FIGS. 2B to 2D being achieved by any combination of on and off for the pixels.

The present invention is applicable to panel-type image display apparatuses, such as, LCD, PDP, DLP, FED and EL, equipped with the display panel 10 having the pixels Px arranged in a matrix. Described next is an outline structure of a projection display apparatus, as an example, equipped with an active matrix liquid crystal device as the display panel 10, in this embodiment.

In FIG. 3, an incident light beam Lin generated by a light source (not shown) is incident to a polarization beam splitter 11. The incident beam Lin carries an S-polarized beam component indicated by "•" and a P-polarized beam component indicated by "-". The S-polarized beam component is reflected at a junction surface 111 of the beam splitter 11 whereas the P-polarized beam component passes therethrough. Thus, the incident beam Lin reflected at the junction surface 111 of the beam splitter 11 is the S-polarized beam component only which is then incident to the display panel 10. The display panel 10 has a semiconductor substrate 101 with reflective pixel electrodes 103 formed thereon so as to correspond to the respective pixels Px and a transparent substrate 102 with a transparent opposing electrode 104 formed thereon, the pixel electrodes 103 and the opposing electrode 104 facing each other with a liquid crystal layer 105 provided therebetween.

The light beam, incident to the display panel 10, carrying the S-polarized beam component only, is reflected at each reflective pixel electrode 103 and is then modulated by liquid crystals of the liquid crystal layer 105 in accordance with an image signal. A part of the S-polarized beam component emitted from the display panel 10 turns into a P-polarized beam component due to modulation through the liquid crystal layer 105 and is then incident to the junction surface 111 of the polarization beam splitter 11, as a light beam carrying the S- and P-polarized beam components. The light beam passes through the junction surface 111 of the beam splitter 11 carries the P-polarized beam component only which is then projected onto a screen 13 via a projection lens 12. Accordingly, an image is displayed on the screen 13 in accordance with an image signal.

The present invention drastically enhances representable gradation levels, compared to known technology with dither only, by introducing multi-gradation representation based on time-division subframe-period driving in addition to the dither-based multi-gradation representation discussed above. Several embodiments of the present invention will be described below one by one.

First Embodiment

The first embodiment performs grouping pixels Px in a display panel 10 per 2 pixels of 2 rows×1 column and addition of a dither signal Sd, explained with reference to FIG. 1, of 2 rows×1 column to pixel data of each group.

Figure 4:
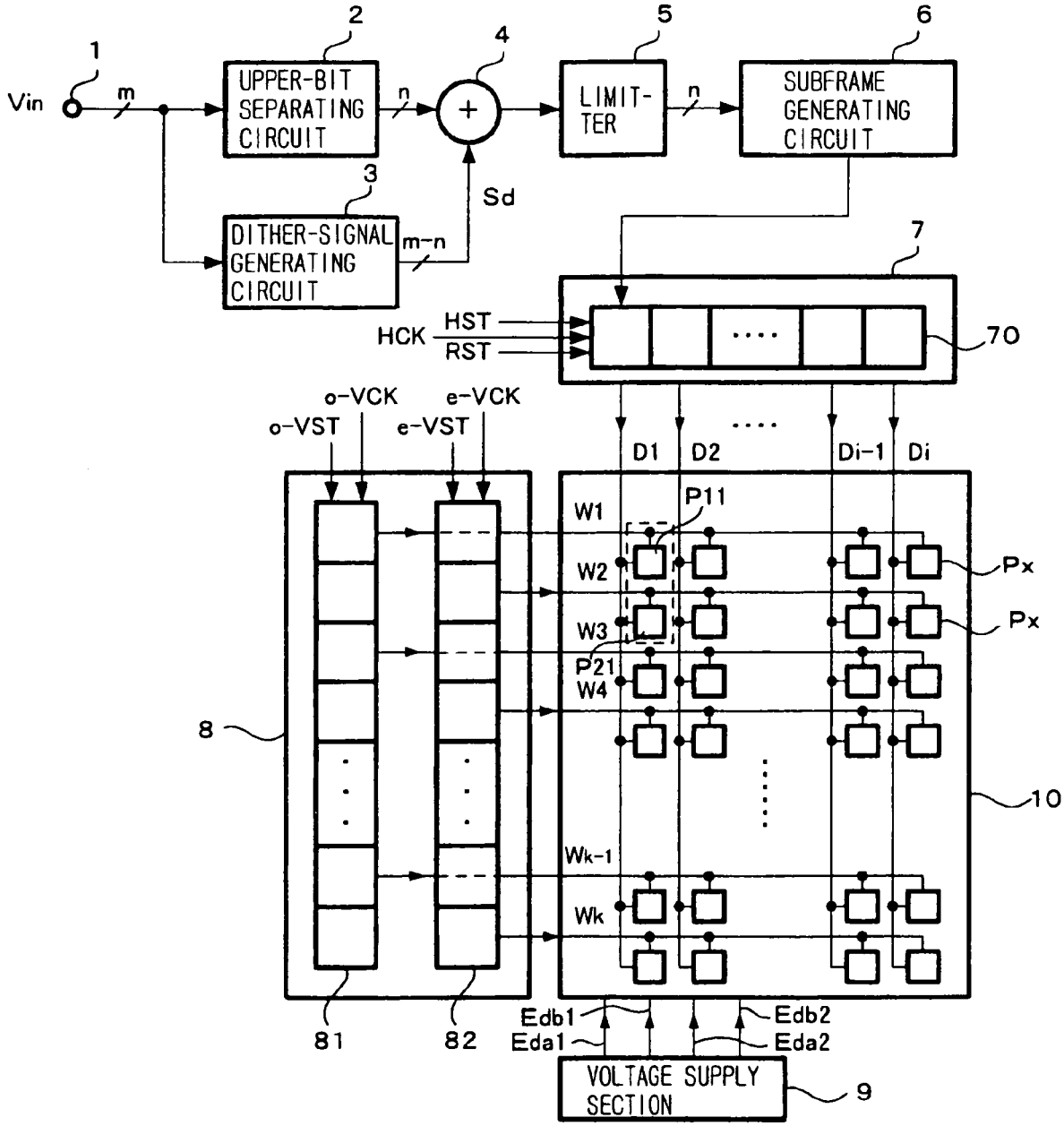
FIG. 4 is a block diagram depicting a first embodiment of the present invention.

In FIG. 4, input via a terminal 1 is a digital image signal Vin of "m" bits (m being an integer of 2 or more) from an image signal supplier (not shown). The image signal Vin is then input to an upper-bit separating circuit 2 and a dither-signal generating circuit 3. The upper-bit separating circuit 2 separates "n" upper bits (n being a positive integer smaller than m) from the "m"-bit image signal Vin and outputs the separated bits. The reason why lower "m-n" bits are eliminated by the upper-bit separating circuit 2 is that the display panel 10 possesses the representing performance of only "n" bits for the image signal Vin of "m" bits. For simplification, the description will continue with 7 for "m" and 5 for "n".

The dither-signal generating circuit 3 generates a dither signal Sd by using lower 2-bit data of an input 7-bit image signal Vin. The dither signal Sd is data of 2 rows×1 column in the first embodiment. In another case, the dither signal Sd may be a preset pattern which is not generated by using a data portion of the image signal Vin, thus having no relation to the image signal Vin. An adder 4 adds a 5-bit image signal output by the upper-bit separating circuit 2 and a 2-bit dither signal Sd output by the dither-signal generating circuit 3. A limiter 5 outputs a signal while restricting a data portion that exceeds a data portion representable with 5 bits in the output of the adder 4 (so-called underflow). Accordingly, while the 7-bit image signal Vin is restricted to the upper 5 bits, by adding the dither signal Sd based on the lower 2 bits to the upper 5 bits, it turns into a multi-gradation-applied signal enhanced to gradation levels which appear to correspond to 7 bits, although the restricted signal Vin is a 5-bit data.

The 5-bit image signal output by the limitter 5 is input to a subframe generating circuit 6. The subframe generating circuit 6 divides each frame of the input image signal into subframes, thus generating a subframe signal. Frames and subframes are referred to in this embodiment, given that the image signal is a non-interlaced signal (progressive signal). The image signal may however be an interlaced signal with fields and subfields. The frames and subframes are defined as generic terms including fields and subfields.

Figure 5:
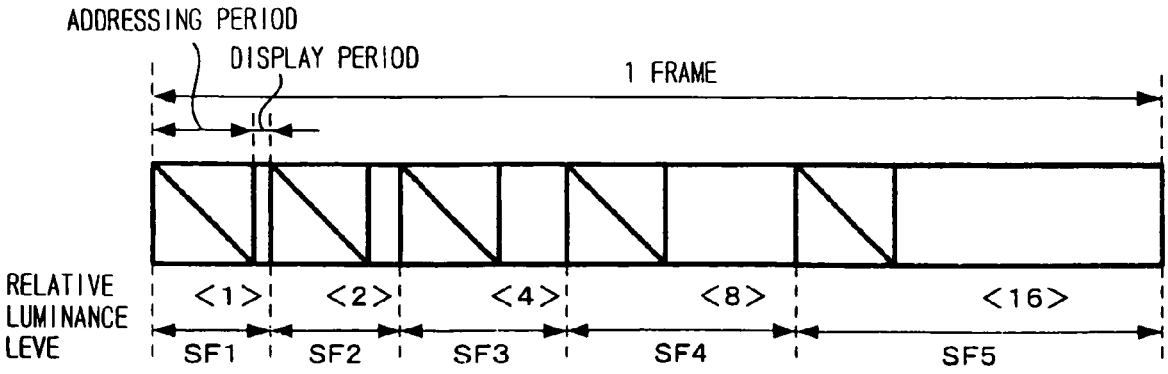
FIG. 5 is a view illustrating subframe division.

Subframe signals are generated as described below as an example. Data of the least-significant bit of a 5-bit image signal is given as data of a subframe SF1, with data of the second bit next to the least-significant bit to the most significant bit being given as data of subframes SF2 to SF5, respectively. As shown in FIG. 5, each of the subframes SF1 to SF5 consists of an addressing period in which data is transferred to each pixel Px in the display panel 10, within one subframe, and a display period for displaying data in a subframe. The subframes SF1 to SF5 are weighted by relative luminance levels of, for example, 1, 2, 4, 8 and 16. There are variety of ways in division of one frame into a plurality of subframes and arrangements of subframes over one frame period, hence not limited to those illustrated in FIG. 5.

Subframe signals generated by the subframe generating circuit 6 are sequentially supplied to a column-signal electrode driving circuit 7 equipped with a shift register 70 for horizontal transfer. The shift register 70 is equipped with "i" transfer stages (i being an integer of 2 or more) which are connected to column-signal electrodes D1 to Di, respectively, in the display panel 10. Supplied to the shift register 70 are horizontal start signals HST and horizontal shift clocks HCK, from a drive timing pulse generating circuit, not shown. Based on the horizontal start signals HST and the horizontal shift clocks HCK, the shift register 70 transfers data per line carried by the input subframe signals sequentially in the horizontal direction and supplies them to the column-signal electrodes D1 to Di. In resetting display of data on the display panel 10, a reset signal RST is supplied from the drive timing pulse generating circuit to the shift register 70.

Connected to row-scanning-signal electrodes W1 to Wk (k being an integer of 2 or more) in the display panel 10 is a row-scanning-signal electrode drive circuit 8. The row-scanning-signal electrodes W1 to Wk are driven by the row-scanning-signal electrode drive circuit 8. In the first embodiment, the row-scanning-signal electrode drive circuit 8 is equipped with a shift register 81 for vertical transfer connected to row-scanning-signal electrodes W1, W3, W5, . . . , on odd rows, and a shift register 82 for vertical transfer connected to row-scanning-signal electrodes W2, W4, W6, . . . , on even rows.

Pixels Px are provided at intersections of the column-signal electrodes D1 to Di and the row-scanning-signal electrodes W1 to Wk in the display panel 10. Supplied to the shift register 81 are vertical start signals $_o$-VST on the odd rows synchronized with the start timings of the respective suframe signals and vertical shift clocks $_o$-VCK on the odd rows synchronized with the horizontal periods of the suframes, from a drive timing pulse generating circuit, not shown. Supplied to the shift register 82 are vertical start signals $_e$-VST on the even rows synchronized with the start timings of the respective suframe signals and vertical shift clocks $_e$-VCK on the even rows synchronized with the horizontal periods of the suframes, from a drive timing pulse generating circuit, not shown. Accordingly, data per line supplied to the column-signal electrodes D1 to Di are supplied to the pixels Px on the rows corresponding to respective lines by the sift registers 81 and 82.

Figure 6:
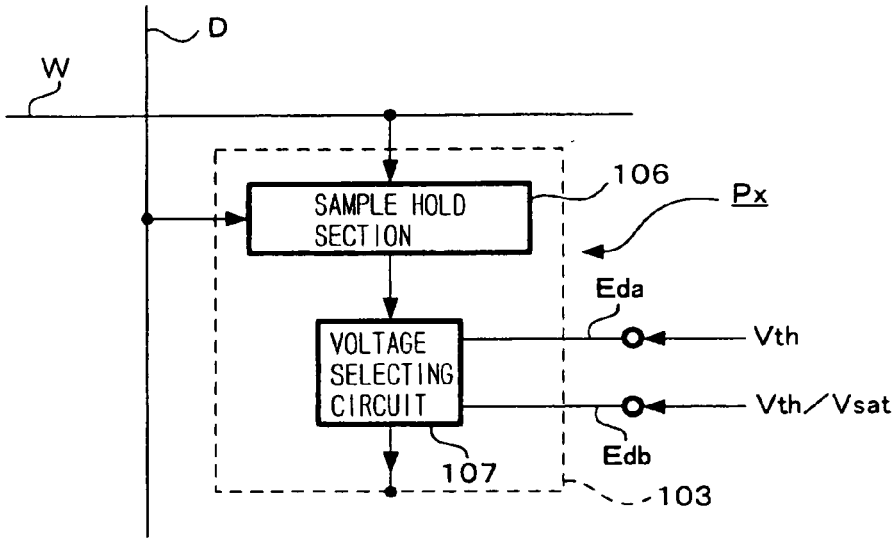
FIG. 6 is a view showing an outline structure of a drive circuit provided for each pixel.
Figure 7:
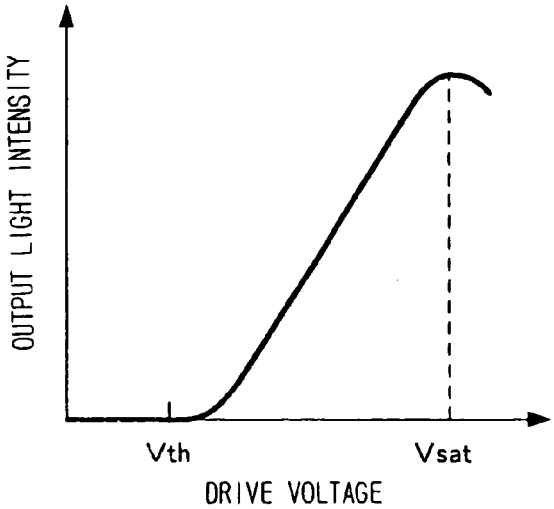
FIG. 7 is a characteristic curve showing a relation between a drive voltage applied to a liquid crystal layer and an output light intensity.

Described now with reference to FIGS. 6 and 7 is a drive circuit provided for each pixel Px. FIG. 6 shows a drive circuit provided for one pixel Px. In FIG. 6, D represents the column-signal electrodes D1 to Di and W the row-scanning-signal electrodes W1 to Wk. Provided for each pixel Px is a sample hold section 106 connected to the column-signal electrode D and the row-scanning-signal electrode W. The sample hold section 106 is made up of, for example, a flip-flop of DRAM or SRAM structure. The sample hold section 106 is connected to a voltage selecting circuit 107 which is then connected to a pixel electrode 103. The pixel electrode 103 is driven by a transistor pixel drive circuit, not shown.

Applied to one of the electrodes connected to the voltage selecting circuit 107, an electrode Eda, is a threshold voltage Vth from a voltage supply section 9 shown in FIG. 4 for both the addressing and display periods, and to the other electrode Edb are the threshold voltage Vth for the addressing period and a saturation voltage Vsat for the display period from the voltage supply section 9 shown in FIG. 4. As shown in FIG. 4, electrodes Eda1 and Edb1 represent the electrodes Eda and Edb, respectively, for the pixels Px connected to the row-scanning-signal electrodes W1, W3, W5, . . . , on the odd rows, and electrodes Eda2 and Edb2 represent the electrodes Eda and Edb, respectively, for the pixels Px connected to the row-scanning-signal electrodes W2, W4, W6, . . . , on the even rows. All of the pixels Px on the odd rows are connected together to the electrodes Eda1 and Edb1, whereas those on the even rows to the electrodes Eda2 and Edb2.

FIG. 7 shows a relation between a drive voltage applied to the liquid crystal layer 105 in the display panel 10 and an output light intensity. The threshold voltage Vth to be applied to the electrode Eda, and to the electrode Edb for the addressing period, of the voltage selecting circuit 107, has a voltage level just before the level at which the output light intensity rises, as shown in FIG. 7, the saturation voltage Vsat to be applied to the electrode Edb for the display period having a voltage level at which the output light intensity saturates. The addressing period for which the threshold voltage Vth is supplied to both the electrodes Eda and Edb gives a black display mode. The addressing period for which the threshold voltage Vth is supplied to the electrode Eda and the saturation voltage Vsat to the electrode Edb gives a display mode depending on the saturation voltage Vsat. The output light intensity depends on the drive voltage, hence it varies when the saturation voltage Vsat supplied to the electrode Edb varies. Arrangements, as shown in FIG. 4, in which different electrodes are connected to the pixels Px on the odd and even rows offer different voltage levels to be applied to the pixels Px on the odd and even rows, as discussed later.

Data per line carried by a subframe signal and supplied to the column-signal electrode D is transferred to a pixel Px located at the intersection of the column-signal electrode D and the row-scanning-signal electrode W when the row-scanning-signal electrode W turns on. The data transferred to the pixel Px is held at the sample hold section 106 for the addressing period, described with reference to FIG. 5. In accordance with the data held at the sample hold section 106, the threshold voltage Vth and the saturation voltage Vsat are selectively supplied to the pixel electrode 103 from the voltage selecting circuit 107. The respective pixels Px turn on or off, accordingly.

As described above, the pixels Px on the odd rows in the display panel 10 are controlled by the shift register 81 for on and off, whereas those on the even rows by the shift register 82 for on and off.

In the image display apparatus of the first embodiment as configured above, the dither-signal generating circuit 3 generates a dither signal Sd of 2 rows×1 column which is added to pixel data of each group of pixels Px of 2 rows×1 column in the display panel 10. As shown in 4, in the first embodiment, the row-scanning-signal electrode drive circuit 8 is equipped with the shift register 81 connected to the row-scanning-signal electrodes W1, W3, W5, . . . , on the odd rows, and the shift register 82 connected to row-scanning-signal electrodes W2, W4, W6, . . . , on the even rows, which allows the pixels Px to be grouped in the same group unit as those to be added the dither signal Sd, such as pixels P11 and P21 surrounded by a dashed line, in the display panel 10.

Figure 8:
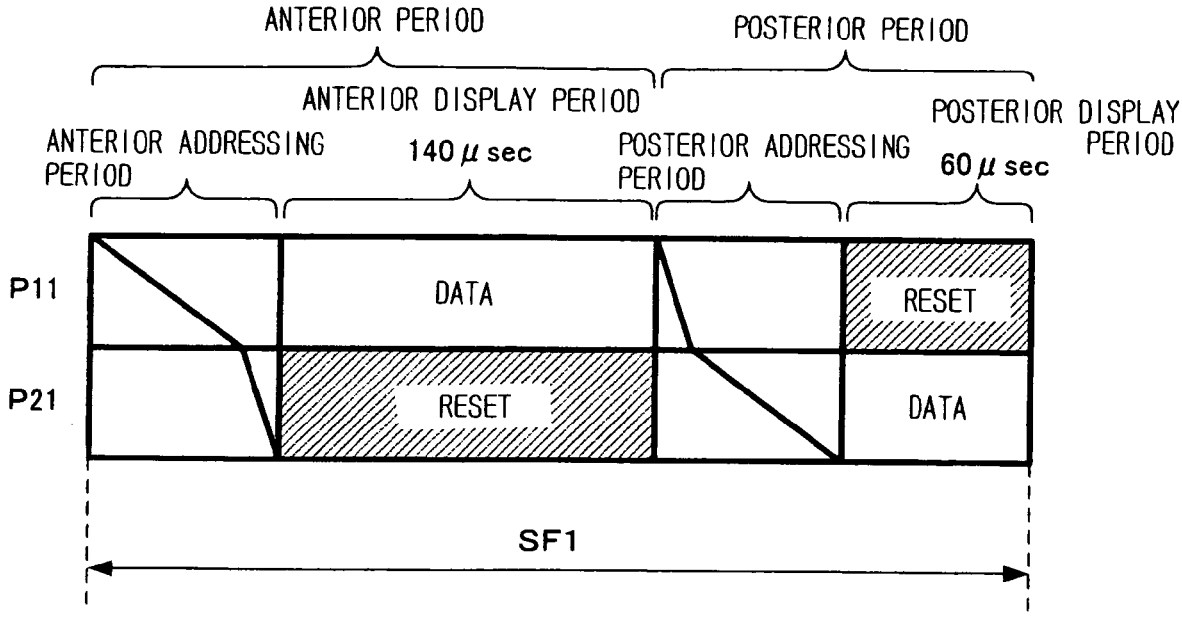
FIG. 8 is a view illustrating a drive method according to the first embodiment.

Given that the pixels Px are divided into groups of 2 rows×1 column in the display panel 10, in the first embodiment, the display panel 10 is driven for at least one subframe of a plurality of subframes, as shown in FIG. 8. FIG. 8 illustrates a drive sequence for a subframe SF1 in one group. Illustrated in FIG. 8 is for a group of pixels P11 and P21, the same applied for other groups. The total period for the subframe SF1 is divided into two primary periods: an anterior period consisting of an anterior addressing period and an anterior display period; and a posterior period consisting of a posterior addressing period and a posterior display period. The anterior display period and the posterior display period are set at 140 μsec. and 60 μsec., respectively, as an example. The lengths of the anterior display period and the posterior display period can be set according to the application time of the saturation voltage Vsat to the electrodes Edb1 and Edb2 from the voltage supply section 9.

On the pixel P11, data of the subframe SF1 is displayed for the posterior display period, and then display is reset for the posterior display period, driven by the column-signal electrode driving circuit 7 and the shift register 81 of the row-scanning-signal electrode drive circuit 8. On the pixel P21, display is reset for the anterior display period, and then the data of the subframe SF1 is displayed for the posterior display period, driven by the column-signal electrode driving circuit 7 and the shift resister 82 of the row-scanning-signal electrode drive circuit 8. Resetting periods always offer an off state (a black display mode), whereas data display periods offer an on state (a display mode) or off state (a black display mode) depending on the data of the subframe SF1. Illustrated in the anterior and posterior addressing periods shown in FIG. 8 are slant lines indicating elapse of period which have a gentle slope for the data display periods whereas a steep slope for the resetting periods due to the fact that data display takes a specific period of time whereas resetting is done instantaneously.

Figure 9A:
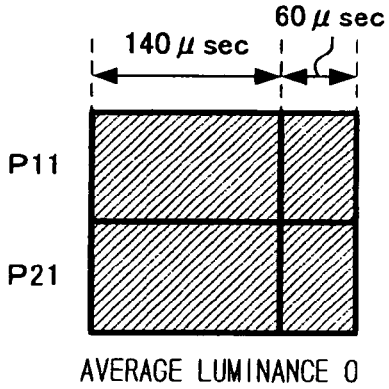
FIGS. 9A to 9D are views illustrating advantages of the drive method according to the first embodiment.
Figure 9B:
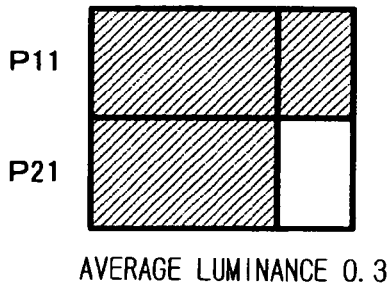
Figure 9C:
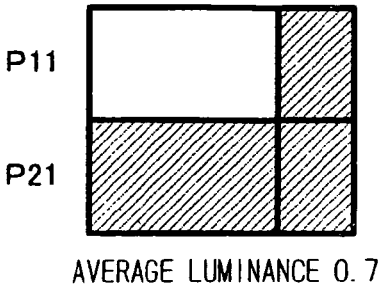
Figure 9D:
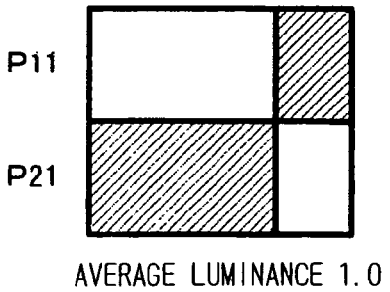

Discussed with reference to FIGS. 9A to 9D is gradation representable through the drive technique illustrated in FIG. 8. Illustrated in FIGS. 9A to 9D is only for the anterior and posterior display periods. As shown in FIG. 9A, the average luminance is 0 for the group of pixels P11 and P21 when the anterior display period for the pixel P11 and the posterior display period for the pixel P21 are both off. As shown in FIG. 9B, the average luminance is 0.3 for the group of pixels P11 and P21 when the anterior display period for the pixel P11 is off, while the posterior display period for the pixel P21 is on. As shown in FIG. 9C, the average luminance is 0.7 for the group of pixels P11 and P21 when the anterior display period for the pixel P11 is on, while the posterior display period for the pixel P21 is off. As shown in FIG. 9D, the average luminance is 1 for the group of pixels P11 and P21 when the anterior display period for the pixel P11 and the posterior display period for the pixel P21 are both on.

The ratio of length of period for the anterior display period and the posterior display period can be set freely within periods of time in the total period of a subframe, except for the periods of time required for the addressing periods, which allows that any intermediate luminance is set freely between the average luminance 0 and 1 for one group. In contrast, quasi-multi-gradation using a conventional dither with addition of a dither signal Sd of 2 rows×1 column, with no row-division driving through the shift registers 81 and 82 in the display panel 10, can represent only the intermediate luminance of 0.5 between the average luminance 0 and 1 for one group. Therefore, according to the first embodiment, representable intermediate gradation levels can be enhanced compared to the conventional dither. In contrast with a conventional technique, in which 1-bit quasi-intermediate gradation levels are added to a 5-bit image signal, representing gradation of 32×2=64 levels, the first embodiment achieves 32×3=96 gradation levels.

The drive technique in the first embodiment, a combination of dither and time division of the subframe period illustrated in FIGS. 8 and 9A to 9D is applied at least to one subframe as described above, i.e., can be applied every subframe. For one subframe only, it is preferable to apply the drive technique to the subframe SF1 only, which is the least-significant subframe.

As understandable from FIG. 7, for each pixel Px, the output light intensity depends on the voltage level of the saturation voltage Vsat. The average luminance in FIGS. 9B and 9C thus varies depending on the voltage level of the saturation voltage Vsat supplied to the electrode Edb1 of each pixel Px on the odd rows and the electrode Edb2 of each pixel Px on the even rows from the voltage supply section 9. Therefore, representable intermediate gradation levels are enhanced further with change in voltage level of the saturation voltage Vsat supplied to the electrode Edb1 of each pixel Px on the odd rows and the electrode Edb2 of each pixel Px on the even rows, in addition to the arrangements described above.

Second Embodiment

The second embodiment performs grouping pixels Px in a display panel 10 per 4 pixels of 4 rows×1 column and addition of a dither signal Sd of 4 rows×1 column to pixel data of each group, based on the dither signal Sd described with reference to FIG. 1. The same reference numerals are given to the elements in the second embodiment shown in FIG. 10 that perform substantially the same function as those in the first embodiment shown in FIG. 4, explanation thereof being omitted accordingly.

Figure 10:
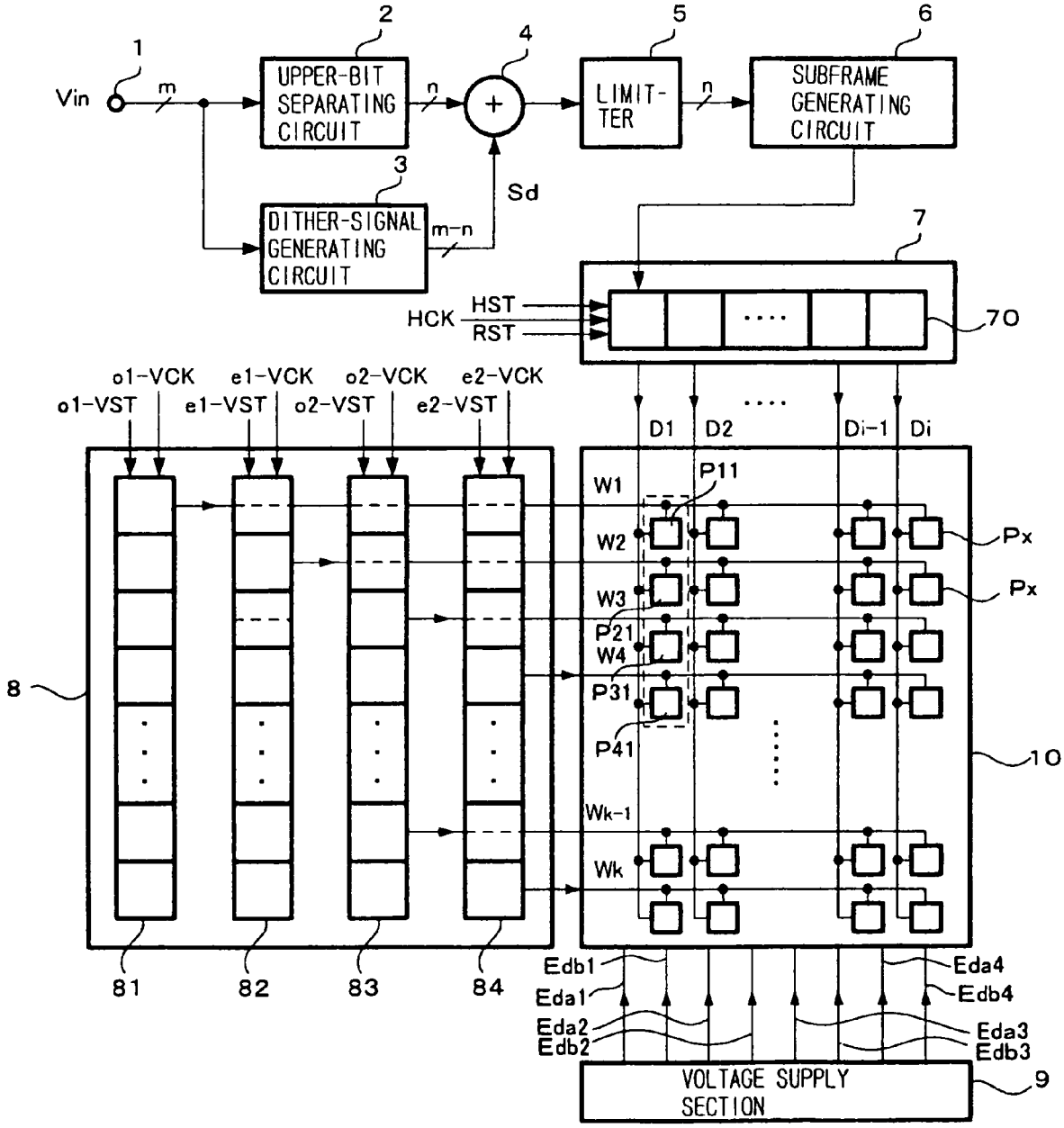
FIG. 10 is a block diagram depicting a second embodiment of the present invention.

As shown in FIG. 10, a row-scanning-signal electrode drive circuit 8 is equipped with a shift register 81 connected to row-scanning-signal electrodes W1, W5, W9, . . . , first odd row electrodes, a shift register 82 connected to row-scanning-signal electrodes W2, W6, W10, . . . , first even row electrodes, a shift register 83 connected to row-scanning-signal electrodes W3, W7, W11, . . . , second odd row electrodes, and a shift register 84 connected to row-scanning-signal electrodes W4, W8, W12, . . . , second even row electrodes.

Supplied to the shift register 81 are vertical start signals $_{o1}$-VST on rows 1, 5, 9, . . . , synchronized with the start timings of the respective suframe signals and vertical shift clocks $_{o1}$-VCK on the rows 1, 5, 9, . . . , synchronized with the horizontal periods of the suframes. Supplied to the shift register 82 are vertical start signals $_{e1}$-VST on rows 2, 6, 10, . . . , synchronized with the start timings of the respective suframe signals and vertical shift clocks $_{e1}$-VCK on the rows 2, 6, 10, . . . , synchronized with the horizontal periods of the suframes. Supplied to the shift register 83 are vertical start signals $_{o2}$-VST on rows 3, 7, 11, . . . , synchronized with the start timings of the respective suframe signals and vertical shift clocks $_{o2}$-VCK on the rows 3, 7, 11, . . . , synchronized with the horizontal periods of the suframes. Supplied to the shift register 84 are vertical start signals $_{e2}$-VST on rows 4, 8, 12, . . . , synchronized with the start timings of the respective suframe signals and vertical shift clocks $_{e2}$-VCK on the rows 4, 8, 12, . . . , synchronized with the horizontal periods of the suframes.

Accordingly, data per line supplied to column-signal electrodes D1 to Di are supplied to the pixels Px on the rows corresponding to respective lines by the shift registers 81 to 84.

Electrodes Eda1 and Edb1 represent electrodes Eda and Edb for the pixels Px connected to the row-scanning-signal electrodes W1, W5, W9, . . . , and electrodes Eda2 and Edb2 represent electrodes Eda and Edb for the pixels Px connected to the row-scanning-signal electrodes W2, W6, W10, . . . Electrodes Eda3 and Edb3 represent electrodes Eda and Edb for the pixels Px connected to the row-scanning-signal electrodes W3, W7, W11, . . . , and electrodes Eda4 and Edb4 represent electrodes Eda and Edb for the pixels Px connected to the row-scanning-signal electrodes W4, W8, W12, . . . All of the pixels Px on the rows 1, 5, 9, . . . , are connected together to the electrodes Eda1 and Edb1, all of the pixels Px on the rows 2, 6, 10, . . . , to the electrodes Eda2 and Edb2, all of the pixels Px on the rows 3, 7, 11, . . . , to the electrodes Eda3 and Edb3, and all of the pixels Px on the rows 4, 8, 12, . . . , to the electrodes Eda4 and Edb4. Applied to each of the electrodes Eda1 to Eda4 and Edb1 to Edb4 are a threshold voltage Vth and a saturation voltage Vsat from a voltage supply section 9. The voltage supply section 9 can apply different saturation voltages Vsat to the electrodes Edb1 to Edb4.

In an image display apparatus of the second embodiment as configured above, a dither-signal generating circuit 3 generates a dither signal Sd of 4 rows×1 column which is added to pixel data of each group of pixels Px of 4 rows×1 column in the display panel 10. The row-scanning-signal electrode drive circuit 8 is equipped with the shift registers 81 to 84, which allows the pixels Px to be grouped in the same group unit as those to be added the dither signal Sd, such as pixels P11, P21, P31 and P41 surrounded by a dashed line, in the display panel 10.

Figure 11:
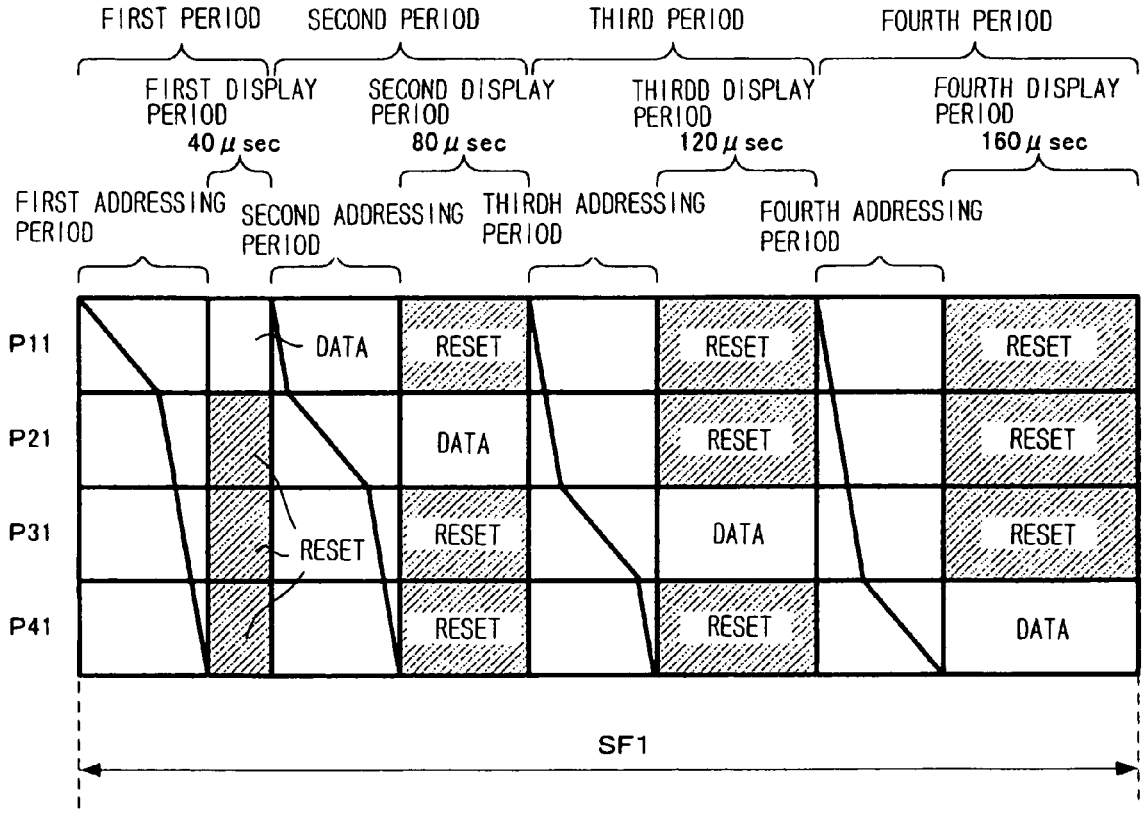
FIG. 11 is a view illustrating a drive method according to the second embodiment.
Figure 12A:
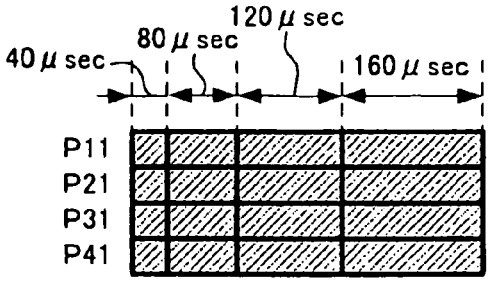
FIGS. 12A to 12K are views illustrating advantages of the drive method according to the second embodiment.
Figure 12B:
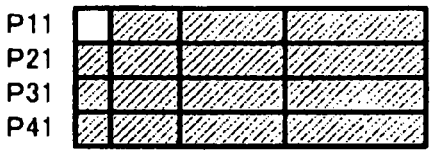
Figure 12C:
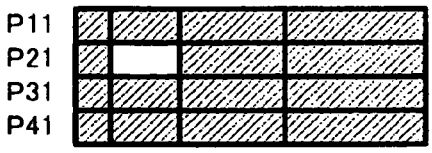
Figure 12D:
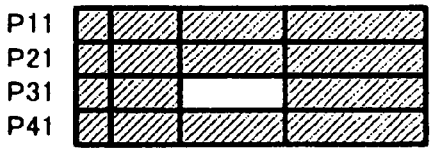
Figure 12E:
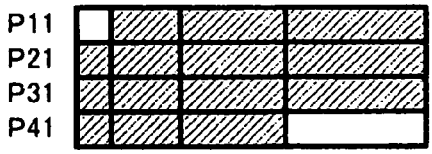
Figure 12F:
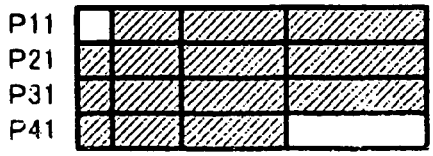
Figure 12G:
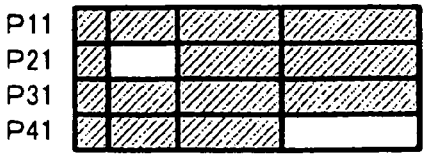
Figure 12H:
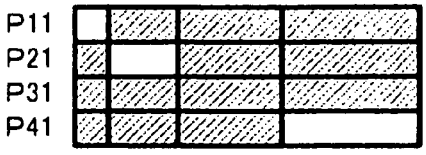
Figure 12I:
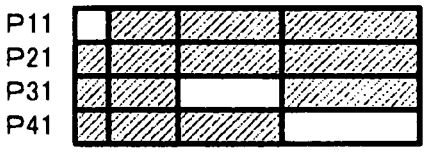
Figure 12J:
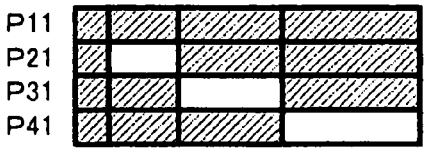
Figure 12K:
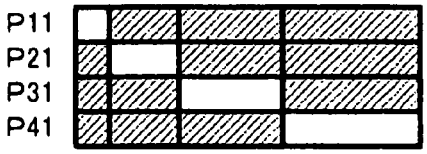

Given that the pixels Px are divided into groups of 4 rows×1 column in the display panel 10, in the second embodiment, the display panel 10 is driven for at least one subframe of a plurality of subframes, as shown in FIG. 11. FIG. 11 illustrates a drive sequence for a subframe SF1 in one group. Illustrated in FIG. 11 is for a group of pixels P11, P21, P31 and P41, the same applied for other groups.

The total period for the subframe SF1 is divided into four primary periods: a first period consisting of a first addressing period and a first display period; a second period consisting of a second addressing period and a second display period; a third period consisting of a third addressing period and a third display period; and a fourth period consisting of a fourth addressing period and a fourth display period. The first, second, third, and fourth display periods are set at 40 μsec., 80 μsec., 120 μsec., and 160 μsec., respectively, as an example. The lengths of the first to fourth display periods are set by the voltage supply section 9.

On the pixel P11, data of the subframe SF1 is displayed for the first display period, and then display is reset for the second to forth display periods, driven by a column-signal electrode driving circuit 7 and the shift register 81 of the row-scanning-signal electrode drive circuit 8. On the pixel P21, display is reset for the first display period, then the data of the subframe SF1 is displayed for the second display period, and display is reset for the third and fourth display periods, driven by the column-signal electrode driving circuit 7 and the shift resister 82 of the row-scanning-signal electrode drive circuit 8. On the pixel P31, display is reset for the first and second display periods, then the data of the subframe SF1 is displayed for the third display period, and display is reset for the fourth display period, driven by the column-signal electrode driving circuit 7 and the shift resister 83 of the row-scanning-signal electrode drive circuit 8. On the pixel P41, display is reset for the first to third display periods, and then the data of the subframe SF1 is displayed for the fourth display period, driven by the column-signal electrode driving circuit 7 and the shift resister 84 of the row-scanning-signal electrode drive circuit 8.

Discussed with reference to FIGS. 12A to 12K is gradation representable through the drive technique illustrated in FIG. 11. As illustrated in FIGS. 12A to 12K, the average luminance can be set at 11 levels from 0 to 1.0 for the group of pixels P11, P21, P31 and P41, by adequately setting on and off for the first to fourth display period.

In contrast with a conventional technique, in which 2-bit quasi-intermediate gradation levels are added to a 5-bit image signal, representing gradation of 32×4=128 levels, the second embodiment achieves 32×10=320 gradation levels, in FIGS. 12A to 12K.

Figure 13A:
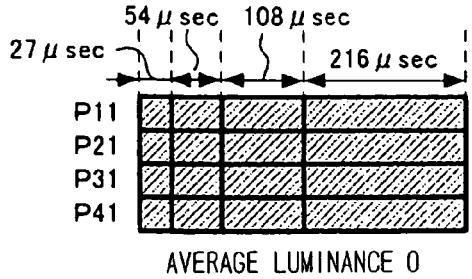
FIGS. 13A to 13P are views illustrating advantages of the drive method according to the second embodiment.
Figure 13B:
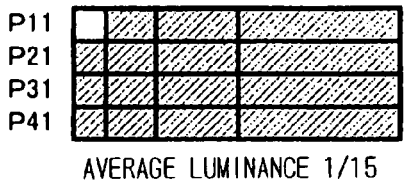
Figure 13C:
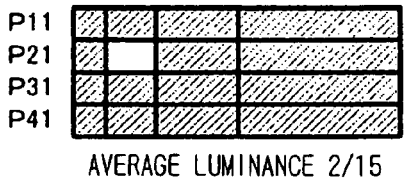
Figure 13D:
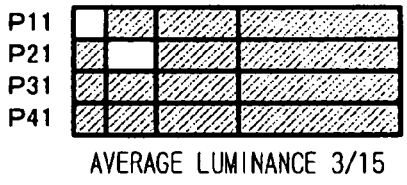
Figure 13E:
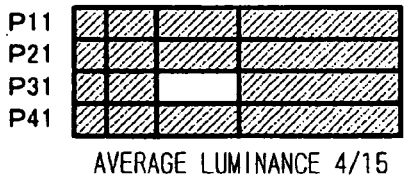
Figure 13F:
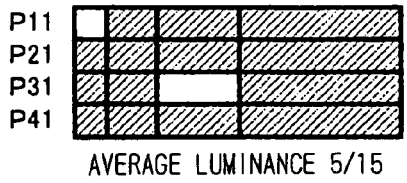
Figure 13G:
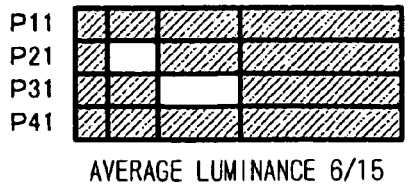
Figure 13H:
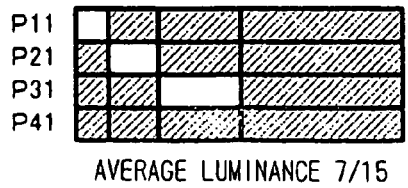
Figure 13I:
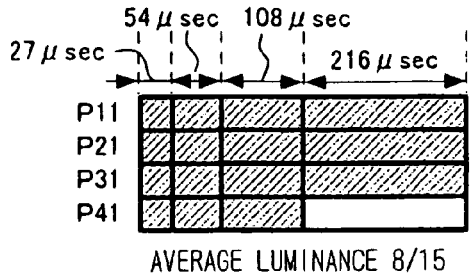
Figure 13J:
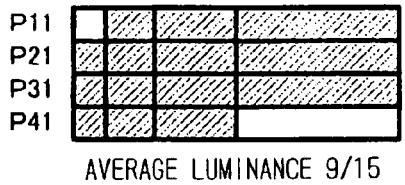
Figure 13K:
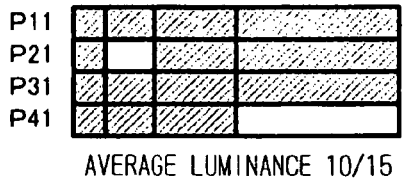
Figure 13L:
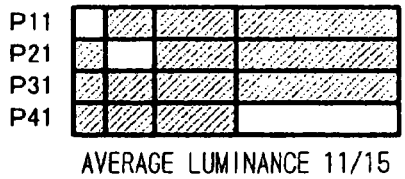
Figure 13M:
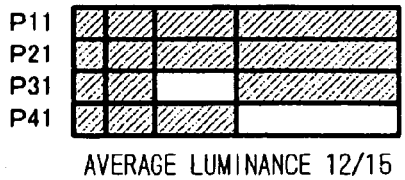
Figure 13N:
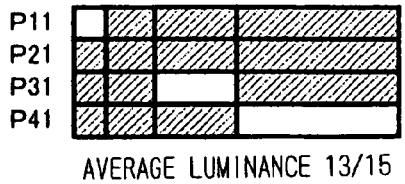
Figure 13O:
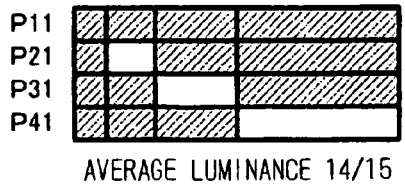
Figure 13P:
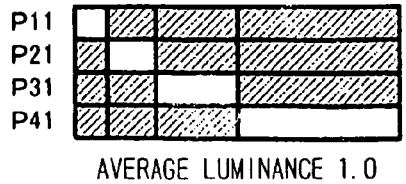

The ratio of length of period for the first to fourth display periods can be set freely within periods of time in the total period of a subframe, except for the periods of time required for the addressing periods, which allows that any intermediate luminance is set freely between the average luminance 0 and 1 for one group. For example, by setting the first, second, third, and fourth display periods at 27 μsec., 54 μsec., 108 μsec., and 216 μsec., respectively, as illustrated in FIGS. 13A to 13P, the average luminance can be set at 16 levels from 0 to 1.0 for the group of pixels P11, P21, P31 and P41. The second embodiment achieves 32×15=480 gradation levels in FIGS. 13A to 13P.

As disclosed above, according to the second embodiment, representable intermediate gradation levels can be enhanced compared to the conventional dither, and enhanced further compared to the first embodiment. Also in the second embodiment, representable intermediate gradation levels are enhanced further with change in voltage level of the saturation voltage Vsat supplied to the electrode Edb1 to Edb4.

Third Embodiment

The third embodiment performs grouping pixels Px in a display panel 10 per 2 pixels of 1 row×2 columns and addition of a dither signal Sd of 1 row×2 columns to pixel data of each group, based on the dither signal Sd described with reference to FIG. 1. The same reference numerals are given to the elements in the third embodiment shown in FIG. 14 that perform substantially the same function as those in the first embodiment shown in FIG. 4, explanation thereof being omitted accordingly.

Figure 14:
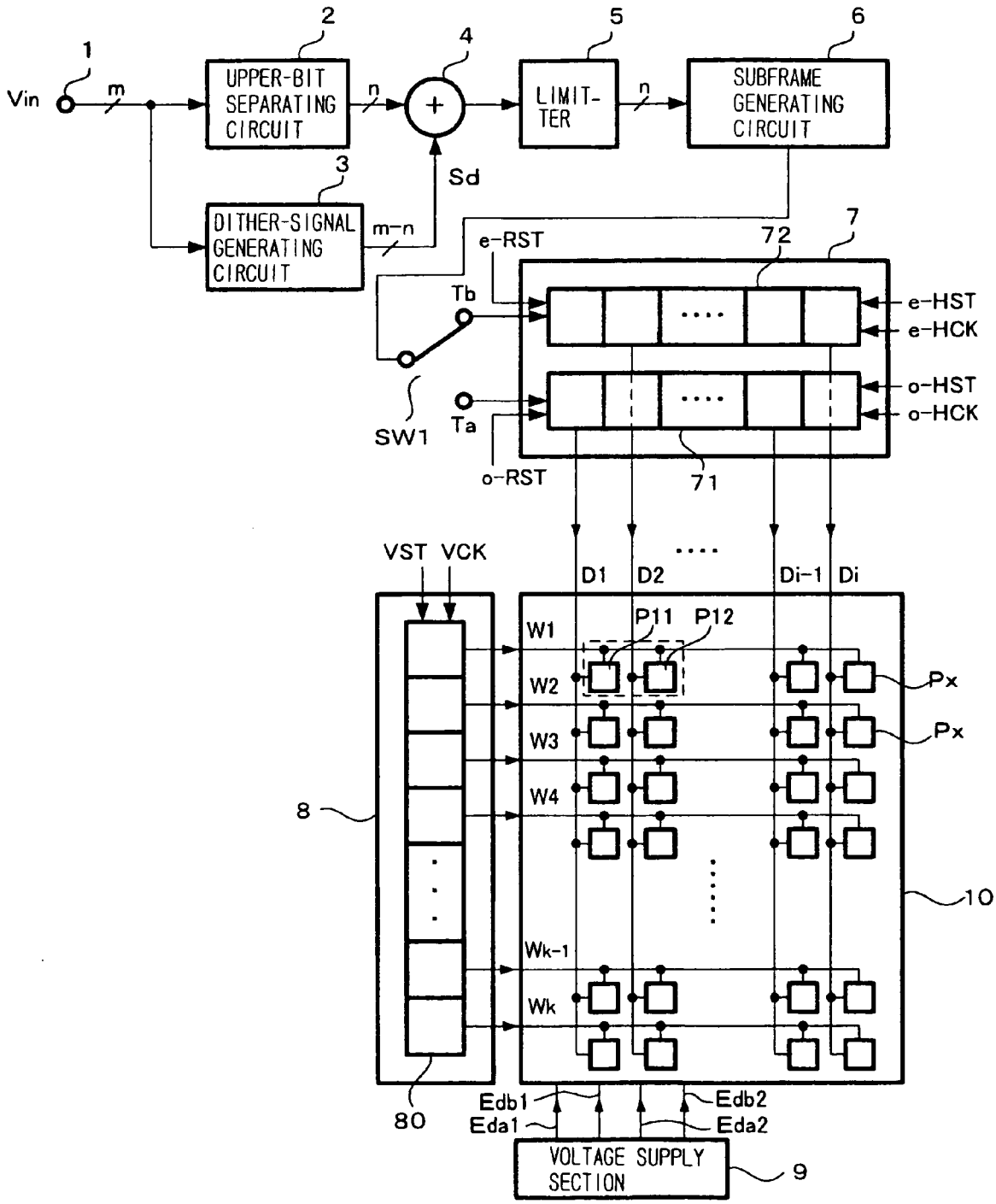
FIG. 14 is a block diagram depicting a third embodiment of the present invention.

In FIG. 14, subframe signals generated by a subframe generating circuit 6 are sequentially supplied to a column-signal electrode driving circuit 7 via a switch SW1. The column-signal electrode drive circuit 7 is equipped with a shift register 71 connected to column-signal electrodes D1, D3, D5, . . . , on odd columns, and a shift register 72 connected to column-signal electrodes D2, D4, D6, . . . , on even columns. The switch SW1 is connected to a terminal Ta when the subframe signals are supplied to the column-signal electrodes D1, D3, D5, . . . , on the odd columns, whereas to a terminal Tb when the signals are supplied to the column-signal electrodes D2, D4, D6, . . . , on the even columns. The switch SW1 is selectively connected to either the terminal Ta or Tb under control by a control circuit, not shown. The control circuit can selectively control the switch SW1 based on information on column numbers.

Supplied to the shift register 71 are horizontal start signals $_o$HST, horizontal shift clocks $_o$HCK on columns 1, 3 and 5 and rest signals $_o$RST for resetting the shift register 71. Supplied to the shift register 72 are horizontal start signals $_e$HST, horizontal shift clocks $_e$HCK on columns 2, 4 and 6 and rest signals $_e$RST for resetting the shift register 72.

In the third embodiment, a row-scanning-signal electrode drive circuit 8 is equipped with a shift register 80 connected to row-scanning-signal electrodes W1 to Wk.

Electrodes Eda1 and Edb1 represent electrodes Eda and Edb for the pixels Px connected to the column-signal electrodes D1, D3, D5, . . . , on the odd columns, and electrodes Eda2 and Edb2 represent electrodes Eda and Edb for the pixels Px connected to the column-signal electrodes D2, D4, D6, . . . , on the even columns. The electrodes Eda1 and Edb1 and the electrodes Eda2 and Edb2 in the third embodiment are not equivalent to the electrodes Eda1 and Edb1 and the electrodes Eda2 and Edb2 in the first embodiment, respectively, but given the same reference signs for convenience. All of the pixels Px on the odd rows are connected together to the electrodes Eda1 and Edb1, and all of the pixels Px on the even rows to the electrodes Eda2 and Edb2. Applied to each of the electrodes Eda1, Eda2, Edb1 and Edb2 are a threshold voltage Vth and a saturation voltage Vsat from a voltage supply section 9. The voltage supply section 9 can apply different saturation voltages Vsat to the electrodes Edb1 and Edb2.

In an image display apparatus of the third embodiment as configured above, a dither-signal generating circuit 3 generates a dither signal Sd of 1 row×2 columns which is added to pixel data of each group of pixels Px of 1 row×2 columns in the display panel 10. The column-signal electrode drive circuit 7 is equipped with the shift registers 71 and 72, which allows the pixels Px to be grouped in the same group unit as those to be added the dither signal Sd, such as pixels P11 and P12 surrounded by a dashed line, in the display panel 10.

Figure 15:
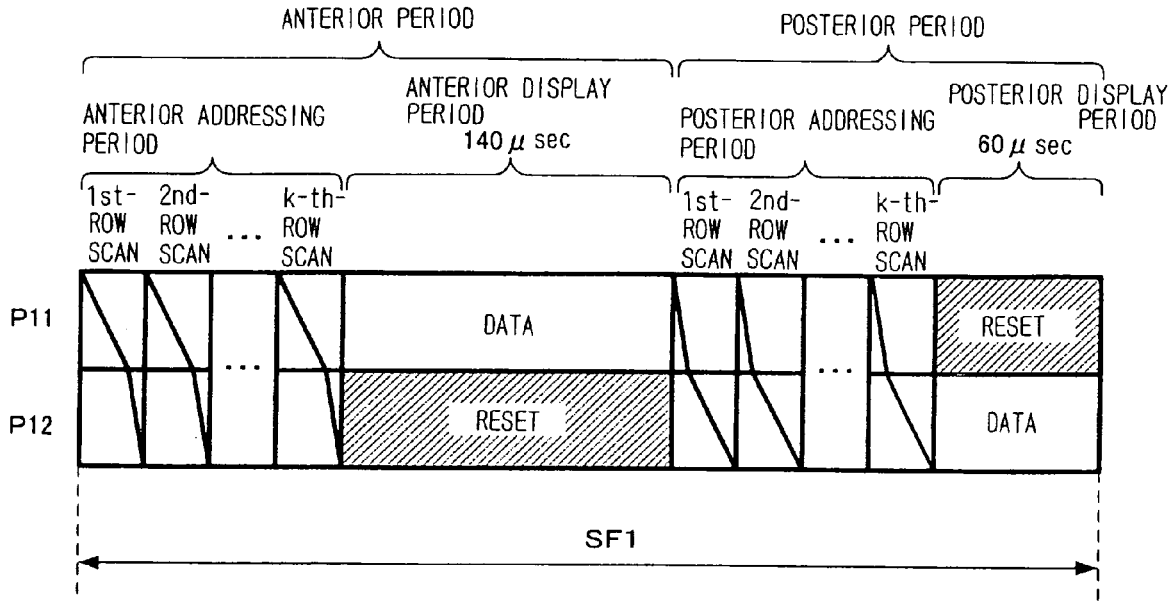
FIG. 15 is a view illustrating a drive method according to the third embodiment.
Figure 16A:
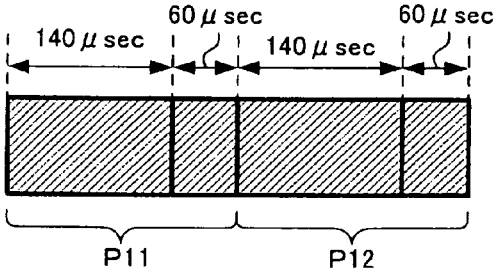
FIGS. 16A to 16D are views illustrating advantages of the drive method according to the third embodiment.
Figure 16B:
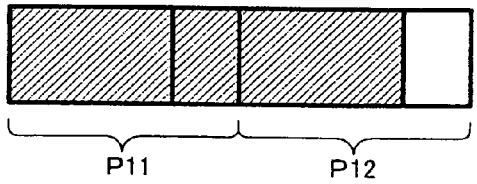
Figure 16C:
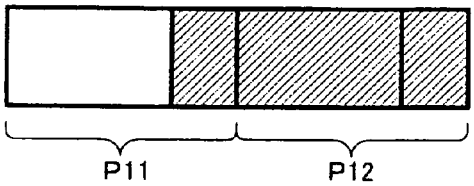
Figure 16D:
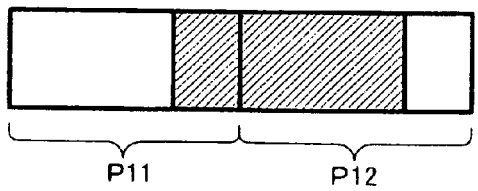

Given that the pixels Px are divided into groups of 1 row×2 columns in the display panel 10, in the third embodiment, the display panel 10 is driven for at least one subframe of a plurality of subframes, as shown in FIG. 15. FIG. 15 illustrates a drive sequence for a subframe SF1 in one group. Illustrated in FIG. 15 is for a group of pixels P11 and P12, the same applied for other groups. The drive sequences for the pixels P11 and P12 are arranged in the vertical direction for convenience in the illustration, which should be arranged in the horizontal direction though. The total period for the subframe SF1 is divided into two primary periods: an anterior period consisting of an anterior addressing period and an anterior display period; and a posterior period consisting of a posterior addressing period and a posterior display period. The anterior display period and the posterior display period are set at 140 μsec. and 60 μsec., respectively, as an example.

On the pixel P11, data of the subframe SF1 is displayed for the posterior display period, and then display is reset for the posterior display period, driven by the shift register 71 of the column-signal electrode driving circuit 7 and the row-scanning-signal electrode drive circuit 8. On the pixel P12, display is reset for the anterior display period, and then the data of the subframe SF1 is displayed for the posterior display period, driven by the shift register 72 of the column-signal electrode driving circuit 7 and the row-scanning-signal electrode drive circuit 8. As shown in FIGS. 16A to 16D, in the third embodiment, the average luminance 0.3 and 0.7 can be given between the average luminance 0 and 1, like the first embodiment explained with reference to FIGS. 9A to 9D. The representable gradation levels are 96 levels in the third embodiment, the same as the first embodiment.

As disclosed above, according to the third embodiment, representable intermediate gradation levels can be enhanced compared to the conventional dither. Also in the third embodiment, representable intermediate gradation levels are enhanced further with change in voltage level of the saturation voltage Vsat supplied to the electrode Edb1 and Edb2.

Fourth Embodiment

The fourth embodiment performs grouping pixels Px in a display panel 10 per 4 pixels of 2 rows×2 columns and addition of a dither signal Sd of 2 rows×2 columns to pixel data of each group, like explained with reference to FIG. 1. The same reference numerals are given to the elements in the fourth embodiment shown in FIG. 17 that perform substantially the same function as those in the first embodiment shown in FIG. 4, explanation thereof being omitted accordingly.

Figure 17:
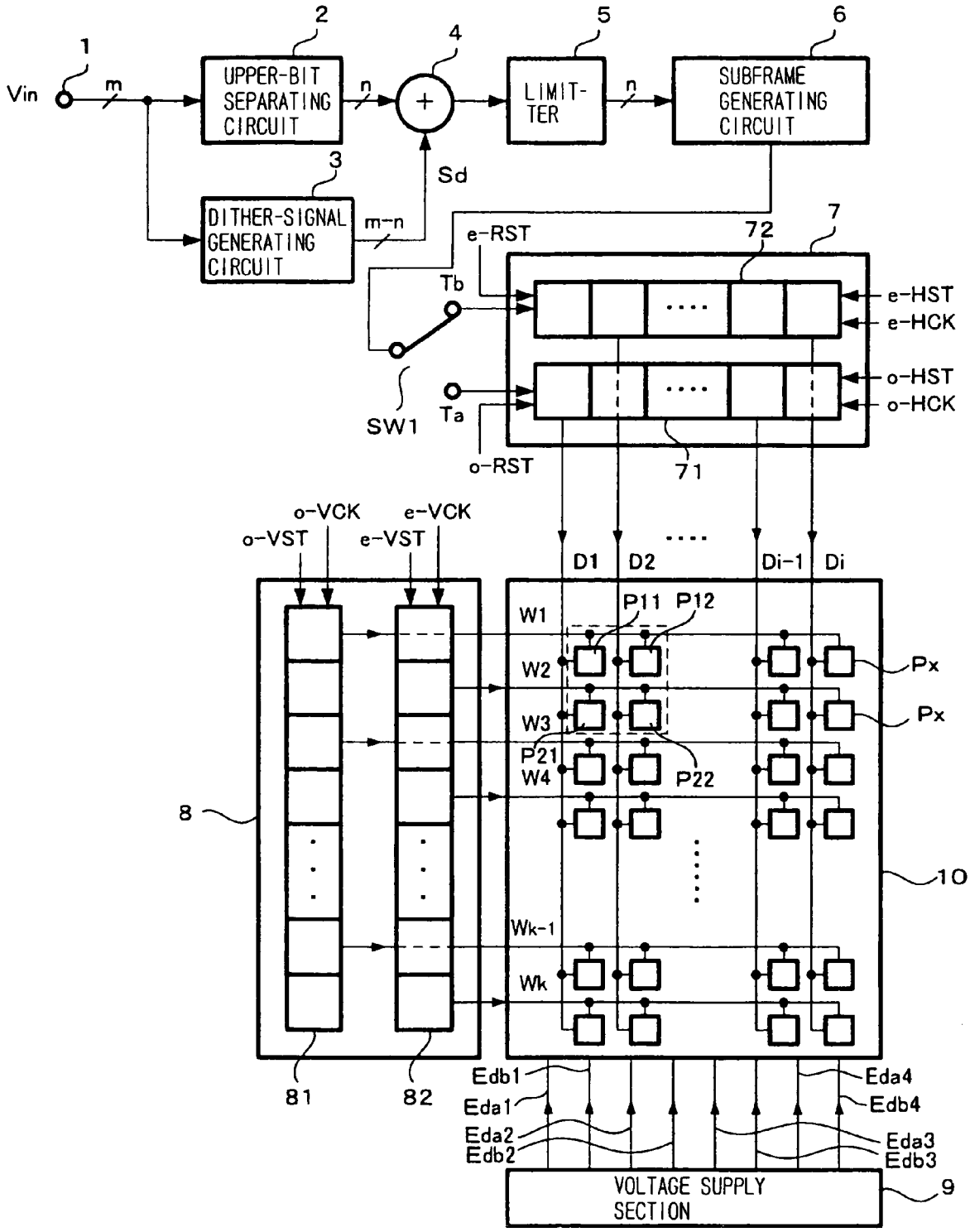
FIG. 17 is a block diagram depicting a fourth embodiment of the present invention.

As shown in FIG. 17, it is the same as the third embodiment in FIG. 14 that the fourth embodiment is provided with a switch SW1 and a column-signal electrode drive circuit 7 equipped with shift registers 71 and 72, and the same as the first embodiment in FIG. 4, provided with a row-scanning-signal electrode drive circuit 8 with shift registers 81 and 82.

In an image display apparatus of the fourth embodiment as configured above, a dither-signal generating circuit 3 generates a dither signal Sd of 2 rows×2 columns which is added to pixel data of each group of pixels Px of 2 rows×2 columns in the display panel 10. The column-signal electrode drive circuit 7 is equipped with the shift registers 71 and 72, which allows the pixels Px to be grouped in the same group unit as those to be added the dither signal Sd, such as pixels P11, P12, P21 and P22 surrounded by a dashed line, in the display panel 10.

All of the left upper pixels Px of all groups (e.g., the pixel P11 in the group of the pixels P11, P12, P21 and P22) are connected together to electrodes Eda1 and Edb1, and all of the right upper pixels Px of all groups (e.g., the pixel P12 in the group of the pixels P11, P12, P21 and P22) to electrodes Eda2 and Edb2. All of the left lower pixels Px of all groups (e.g., the pixel P21 in the group of the pixels P11, P12, P21 and P22) are connected together to electrodes Eda3 and Edb3, and all of the right lower pixels Px of all groups (e.g., the pixel P22 in the group of the pixels P11, P12, P21 and P22) to electrodes Eda4 and Edb4. The electrodes Eda1 to Eda4 and Edb1 to Edb4 in the fourth embodiment are not equivalent to the electrodes Eda1 to Eda4 and Edb1 to Edb4 in the second embodiment, respectively, but given the same reference signs for convenience.

Applied to each of the electrodes Eda1 to Eda4 and Edb1 to Edb4 are a threshold voltage Vth and a saturation voltage Vsat from a voltage supply section 9. The voltage supply section 9 can apply different saturation voltages Vsat to the electrodes Edb1 to Edb4.

Given that the pixels Px are divided into groups of 2 rows×2 columns in the display panel 10, in the fourth embodiment, the display panel 10 is driven for at least one subframe of a plurality of subframes, as shown in FIGS. 18A to 18D. FIGS. 18A to 18D illustrate a drive sequence for a subframe SF1 in one group. Illustrated in FIGS. 18A to 18D is for a group of pixels P11, P12, P21 and P22, the same applied for other groups.

Figure 18A:
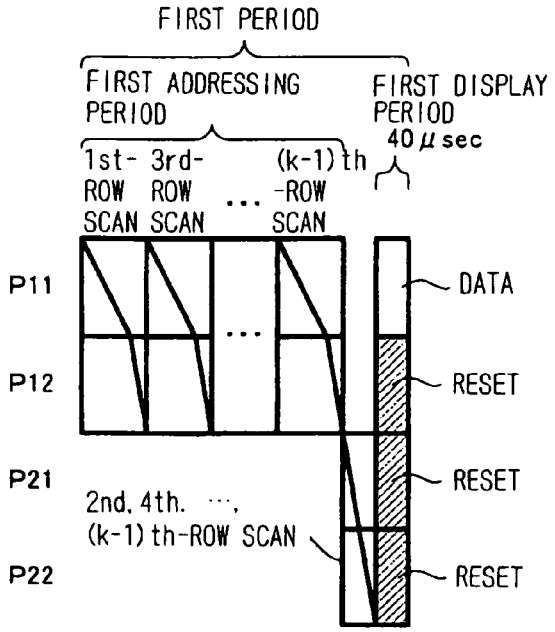
FIGS. 18A to 18D are views illustrating a drive method according to the fourth embodiment.
Figure 18B:
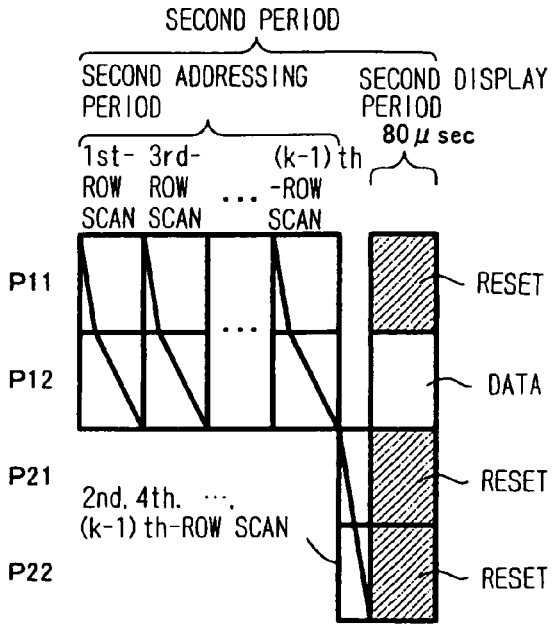
Figure 18C:
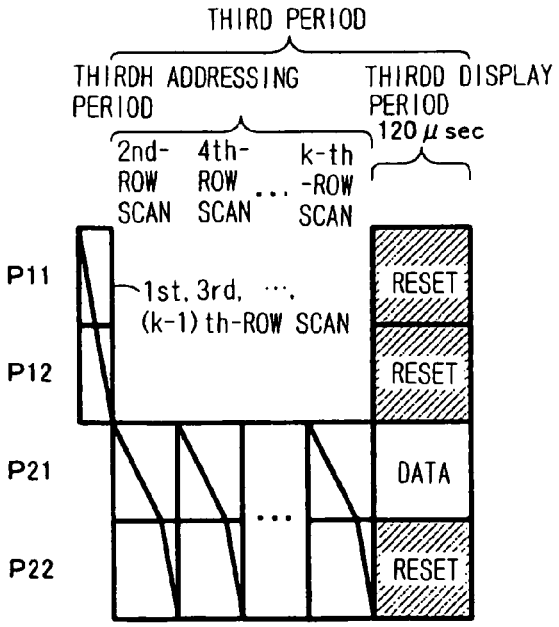
Figure 18D:
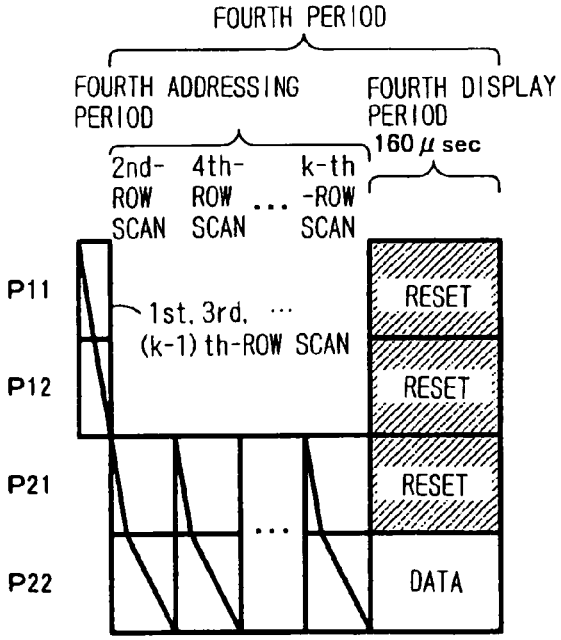

The total period for the subframe SF1 is divided into four primary periods: a first period consisting of a first addressing period and a first display period, shown in FIG. 18A; a second period consisting of a second addressing period and a second display period, shown in FIG. 18B; a third period consisting of a third addressing period and a third display period, shown in FIG. 18C; and a fourth period consisting of a fourth addressing period and a fourth display period, shown in FIG. 18D. The first, second, third, and fourth display periods are set at 40 μsec., 80 μsec., 120 μsec., and 160 μsec., respectively, as an example.

On the pixel P11, data of the subframe SF1 is displayed for the first display period, and then display is reset for the second to forth display periods, driven by the shift register 71 of the column-signal electrode driving circuit 7 and the shift register 81 of the row-scanning-signal electrode drive circuit 8. On the pixel P12, display is reset for the first display period, then the data of the subframe SF1 is displayed for the second display period, and display is reset for the third and fourth display periods, driven by the shift register 71 of the column-signal electrode driving circuit 7 and the shift resister 82 of the row-scanning-signal electrode drive circuit 8. On the pixel P21, display is reset for the first and second display periods, then the data of the subframe SF1 is displayed for the third display period, and display is reset for the fourth display period, driven by the shift register 71 of the column-signal electrode driving circuit 7 and the shift resister 82 of the row-scanning-signal electrode drive circuit 8. On the pixel P22, display is reset for the first to third display periods, and then the data of the subframe SF1 is displayed for the fourth display period, driven by the shift register 71 of the column-signal electrode driving circuit 7 and the shift resister 82 of the row-scanning-signal electrode drive circuit 8.

Also in the fourth embodiment, the average luminance can be set at 11 levels from 0 to 1.0 for the group of pixels P11, P12, P21 and P22, by adequately setting on and off for the first to fourth display period, like the second embodiment. This achieves 320 representable gradation levels, like shown in FIGS. 12A to 12K.

The ratio of length of period for the first to fourth display periods can be set freely within periods of time in the total period of a subframe, except for the periods of time required for the addressing periods, which allows that any intermediate luminance is set freely between the average luminance 0 and 1 for one group. For example, by setting the first, second, third, and fourth display periods at 27 μsec., 54 μsec., 108 μsec., and 216 μsec., respectively, the average luminance can be set at 16 levels from 0 to 1.0 for the group of pixels P11, P12, P21 and P22. This achieves 480 representable gradation levels, like shown in FIGS. 13A to 13P.

As disclosed above, according to the fourth embodiment, representable intermediate gradation levels can be enhanced compared to the conventional dither, and enhanced further compared to the first and third embodiment. Also in the fourth embodiment, representable intermediate gradation levels are enhanced further with change in voltage level of the saturation voltage Vsat supplied to the electrode Edb1 to Edb4.

As described with reference to FIGS. 1 and 2A to 2E, it is common for the dither signal Sd to be formed in a square matrix consisting of 2 rows×2 columns, hence the fourth embodiment being the best mode among the firth to fourth embodiments. Although the configuration becomes complex, it is also preferable to adjust the dither signal Sd as consisting of 3 rows×3 columns or more, with the column-signal and row-scanning-signal electrode drive circuits 7 and 8 each with 3 shift registers or more, thus grouping the pixels Px in the display panel 10 in the same group unit as those to be added the dither signal Sd.

It will be appreciated that the present invention is not limited to the first to fourth embodiments disclosed above, and various changes may be made within the scope of the invention.

As disclosed above in detail, according to the image display apparatus of the present invention, representable gradation levels can be enhanced with no increase in the number of subframes in one frame.

What is claimed is:

1. An image display apparatus having a display section provided with a first plurality of pixels arranged in a matrix, comprising: a dither signal generating circuit to sequentially generate and output dither signals each formed in a matrix of P rows.times.Q columns (P and Q being both positive integers and at least either one being 2 or more) corresponding to a second plurality of pixels that are a part of the first plurality of pixels in the display section, in order to enhance gradation levels of a first image signal; an adder to sequentially add the dither signals to pixel data of the first image signal, thus outputting a second image signal with enhanced gradation levels; a subframe generating circuit to divide one frame of the second image signal into a plurality of subframes, thus generating and outputting a subframe signal; a column-signal electrode drive circuit, having a shift register for use in horizontal transfer, to sequentially supply data per line carried by the subframe signal to column-signal electrodes connected to the pixels of the display section; and a row-scanning-signal electrode drive circuit, having a shift register for use in vertical transfer, to sequentially supply data per line carried by the subframe signal to pixels of rows corresponding to respective lines, wherein at least either one of the column-signal electrode drive circuit and the row-scanning-signal electrode drive circuit has a plurality of shift registers, the first plurality of pixels of the display section are grouped in the same unit of group as the second plurality of pixels through one or more of the shift registers of the column-signal electrode drive circuit and one or more of the shift registers of the row-scanning-signal electrode drive circuit, and the column-signal electrode drive circuit and the row-scanning-signal electrode drive circuit drive the display section to display pixel data of each of the second plurality of pixels in each group for display periods that are provided in the same number as the second plurality of pixels.

2. The image display apparatus according to claim 1, wherein P and Q in the dither signal of P rows×Q columns are equal to each other, and the column-signal electrode drive circuit and the row-scanning-signal electrode drive circuit have a same number of shift registers, with the first plurality of pixels in the display section divided into groups of pixels of P rows×Q columns.

3. The image display apparatus according to claim 1 further comprising a voltage supply section to supply a voltage to each pixel in the display section to turn on the pixel, wherein the voltage supply section supply voltages of different voltage levels to the second plurality of pixels in each group.

* * * * *